US006131007A

United States Patent [19]

Yamaguchi et al.

[11] Patent Number: 6,131,007

[45] **Date of Patent: *Oct. 10, 2000**

[54] DEVELOPING DEVICE, PROCESS CARTRIDGE AND ELECTROPHOTOGRAPHIC IMAGE FORMING APPARATUS

[75] Inventors: Seiji Yamaguchi, Numazu; Atsushi Numagami, Hadano; Minoru Sato; Yoshiyuki Batori, both of Toride, all of Japan

[73] Assignee: Canon Kabushiki Kaisha, Toyko, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/178,500

[22] Filed: Oct. 26, 1998

[30] Foreign Application Priority Data

Oct. 27, 1997 [JP] Japan ..... 9-311442

[51] Int. Cl.[7] ..... G03G 15/08

[52] U.S. Cl. ..... 399/256; 399/111

[58] Field of Search ..... 399/111, 119, 399/252, 254, 256, 262, 263

[56] References Cited

U.S. PATENT DOCUMENTS

| | | | |
|---|---|---|---|
| 5,134,441 | 7/1992 | Nagata et al. | 399/111 X |
| 5,283,616 | 2/1994 | Numagami et al. . | |
| 5,331,373 | 7/1994 | Nomura et al. . | |
| 5,452,056 | 9/1995 | Nomura et al. . | |
| 5,465,140 | 11/1995 | Nakamura et al. | 399/254 |
| 5,500,714 | 3/1996 | Yashiro et al. . | |
| 5,528,341 | 6/1996 | Shishido et al. . | |
| 5,543,898 | 8/1996 | Shishido et al. . | |
| 5,585,889 | 12/1996 | Shishido et al. . | |
| 5,585,895 | 12/1996 | Yashiro et al. . | |
| 5,617,579 | 4/1997 | Yashiro et al. | 399/114 |
| 5,689,774 | 11/1997 | Shishido et al. | 399/111 |
| 5,710,961 | 1/1998 | Jeong | 399/256 |
| 5,768,658 | 6/1998 | Watanabe et al. | 399/111 |
| 5,790,923 | 8/1998 | Oguma et al. | 399/106 |
| 5,835,828 | 11/1998 | Jyoroku | 399/256 |
| 5,845,182 | 12/1998 | Johroku et al. | 399/256 |
| 5,884,130 | 3/1999 | Tsutsumi et al. | 399/254 |

*Primary Examiner*—Sandra Brase

*Attorney, Agent, or Firm*—Fitzpatrick, Cella, Harper & Scinto

[57] ABSTRACT

A developing device for use in an electrophotographic image forming apparatus, includes a developing member for developing a latent image formed on an electrophotographic photosensitive member, a developer containing portion for containing a developer to be used in developing with the developing member, the latent image being formed on the electrophotographic photosensitive member, an agitating member for agitating the developer contained in the developer containing portion, and a frame rotatably supporting the agitating member and having a hole for rotatably supporting the agitating member, of which an end enters the hole and is rotatably supported by the hole. The length of the agitating member in contact with the inner surface of the hole is shorter, in the longitudinal direction of the hole, than the length of the agitating member present in the hole.

31 Claims, 9 Drawing Sheets

DEVELOPING DEVICE, PROCESS CARTRIDGE AND ELECTROPHOTOGRAPHIC IMAGE FORMING APPARATUS

BACKGROUND OF THE INVENTION

1. Field of the Invention

The present invention relates to a developing device and a process cartridge for use in an image forming apparatus such as a copying apparatus or a page printer for forming an image with an electrophotographic image forming process or an electrostatic recording process, and such electrophotographic image forming apparatus.

2. Related Background Art

The image forming apparatus employing an electrophotographic image forming method is provided with developing means for developing a latent image, formed on a photosensitive drum, with toner. Such developing means can be a developing device provided with a developing member for supplying the photosensitive drum with developer, and a developing container for storing the developer, and, such developing container is provided therein with an agitating rod for agitating and transporting the developer. The agitating rod is, for example, crank-shaped and is supported at an end thereof by a driving gear which is rotatably supported on a lateral wall, at the driving side, of the developing container, and also supported at the other end by a lateral wall, at the non-driving side, of the developing container.

Such developing device may be of a type which is incorporated in the main body of the image forming apparatus and in which the developer is replenished into the developing container when the developer contained therein decreases, or a process cartridge type in which the electrophotographic photosensitive member and process means acting on such photosensitive member and including at least the developing means are integrally formed as a cartridge detachable from the main body of the image forming apparatus. Such process cartridge system can significantly improve operability since the maintenance of the apparatus can be executed by the user himself. For this reason, such process cartridge system is widely employed in image forming apparatus.

In the supporting portion of the aforementioned agitating rod, the inner wall of the bearing hole and the agitating rod are in mutual friction, and, if the toner enters such frictional portion, there may be developed coarse toner particles of 20 to 200 $\mu$m by mechanical stamping or eventually thermal fusion of the toner. Such coarse toner particles are mixed with the ordinary toner particles and migrate in the toner container, and may be clogged between the developing limiting member and the developing sleeve.

SUMMARY OF THE INVENTION

An object of the present invention is to provide a developing device, a process cartridge and an electrophotographic image forming apparatus with improved image quality.

Another object of the present invention is to provide a developing device, a process cartridge and an electrophotographic image forming apparatus capable of preventing the production of coarse toner particles.

Still another object of the present invention is to provide a developing device, a process cartridge and an electrophotographic image forming apparatus in which the contact area between the agitating member and the supporting portion therefor is reduced.

Still another object of the present invention is to provide a developing device, a process cartridge and an electrophotographic image forming apparatus in which the length of the agitating member present in a hole provided in a frame is larger, in the longitudinal direction of the hole, than the length of the agitating member in contact with the internal surface of the hole, for being supported by such internal surface.

DETAILED DESCRIPTION OF THE PREFERRED EMBODIMENTS

Figure 1:
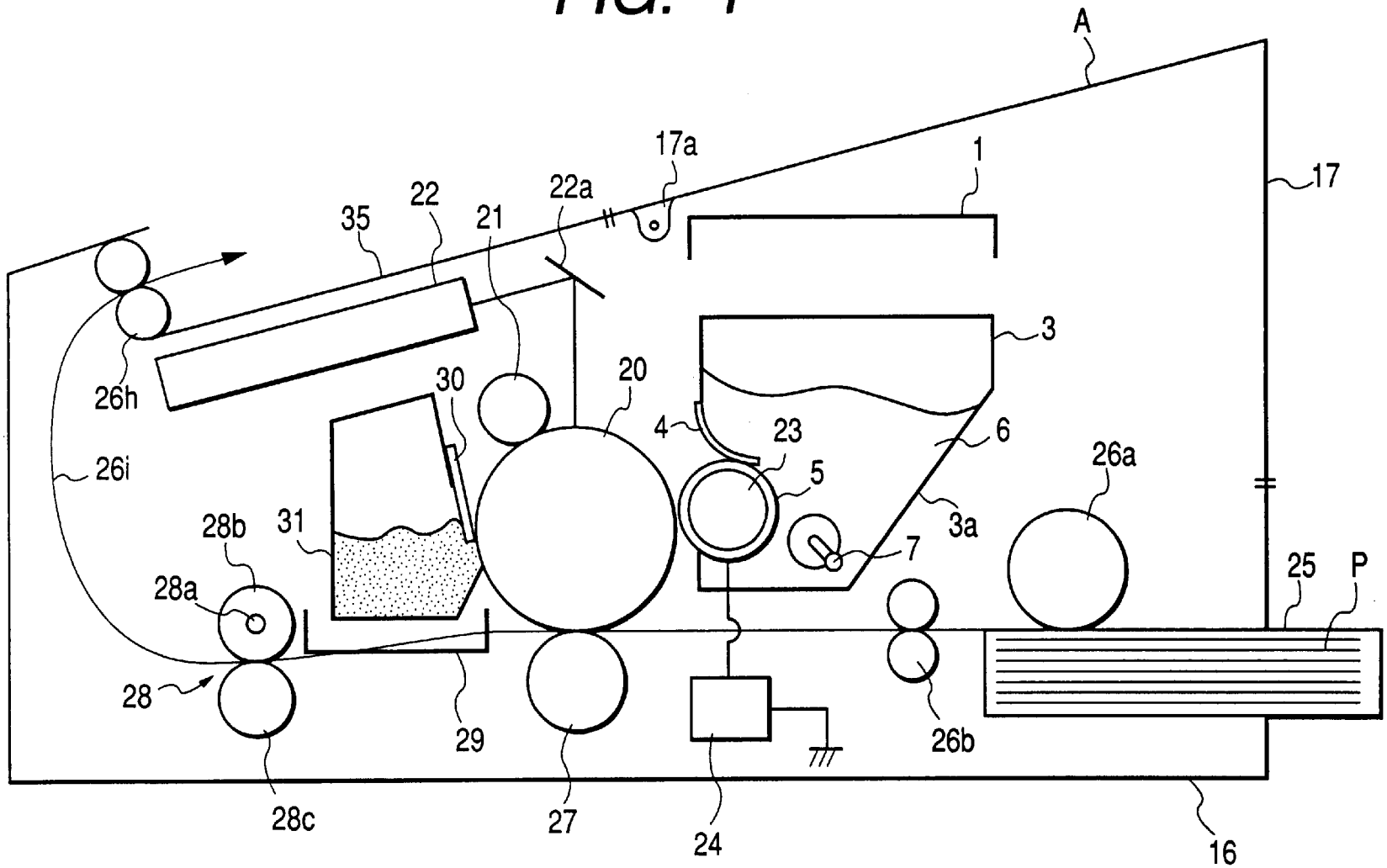
FIG. 1 is a longitudinal cross-sectional view of an electrophotographic image forming apparatus in which the present invention is applicable.

Now the present invention will be clarified in detail by preferred embodiments shown in the attached drawings.

First Embodiment

At first there will be explained, with reference to FIG. 1, the configuration of a general electrophotographic image forming apparatus such as a laser beam printer A. Around a photosensitive drum 20 constituting a latent image bearing member, there are provided a charging roller 21 for uniformly charging the photosensitive drum 20, an optical device 22 for forming an electrostatic latent image on the photosensitive drum 20, a developing device 1 for developing the latent image with toner, a transfer roller 27 constituting transfer means, and a cleaning device 29.

As shown in FIG. 1, the laser beam printer A is to form an image on a recording medium (for example recording paper, OHP sheet, fabric etc.) by an electrophotographic image forming process. A toner image is formed on a drum-shaped electrophotographic photosensitive member (hereinafter called "photosensitive drum"). More specifically, the photosensitive drum is charged by charging means, and irradiated with laser light corresponding to image information from optical means to form a latent image corresponding to the image information on the photosensitive drum. Then the latent image is developed with developing means to form a toner image. In synchronization with the formation of the toner image, the recording medium P set in a sheet cassette 25 is reversed and transported by a pick-up roller 26*a* and paired registration rollers 26*b*.

Then, the toner image formed on the photosensitive drum 20 provided in the main body 16 of the apparatus is transferred onto the recording medium P, by the application of a voltage to a transfer roller 27 constituting transfer means. Subsequently, the recording medium P bearing the transferred toner image is transported, by a transport guide, to fixing means 28, provided with a roller 28*c* and a fixing roller 28*b* incorporating a heater 28*a*. The transferred toner image is fixed by application of heat and pressure to the passing recording medium P, which is then transported by paired discharge rollers 26*h* and is discharged onto a discharge tray 32 through an inversion path 26*i*. The discharge tray 32 is provided on the upper face of the main body 16 of the image forming apparatus A.

In a process cartridge B, the photosensitive drum 20 having a photosensitive layer is rotated, and the surface thereof is uniformly charged by applying voltage to a charging roller 21 constituting the charging means. Then, a laser beam emitted from the optical device 22 and modulated according to image information is reflected by a mirror 22*a* and irradiates the photosensitive drum 20, thereby forming a latent image thereon, which is then developed with toner in the developing device 1. The charging roller 21 is maintained in contact with the photosensitive drum 20 and is rotated by the rotation thereof, whereby the photosensitive drum 20 is charged. The latent image formed on the photosensitive drum 20 is developed by toner supply from the developing device 1 to a developing area on the photosensitive drum 20.

The optical device 22 is provided with a laser diode, a polygon mirror, a lens and a mirror. On the other hand, the cleaning device 29, for eliminating the toner remaining on the photosensitive drum 20 after the transfer of the visible image, formed thereon, onto the recording medium P, is composed of a cleaning blade 30 maintained in contact with the photosensitive drum 20 and a used toner container 31.

The developing device 1 for rendering visible the electrostatic latent image formed on the photosensitive drum 20 is composed of a developer limiting member 4, a developing sleeve 5 constituting a developing carrier member, a toner container 3 containing toner 6 constituting the developer, and an agitating rod 7 for agitating and transporting the toner 6. The toner 6 in the toner container 3 is composed of magnetic toner, or a mixture of magnetic carrier and magnetic or non-magnetic toner. The developing sleeve 5 is composed of a hollow non-magnetic sleeve and is provided therein with a magnet roller 23.

The toner 6 is supported, by the magnetic force of the magnet roller 23 in the developing sleeve 5, on the surface of the developing sleeve 5, and is supplied, in a state of toner coating of an appropriate amount by the developer limiting member 4, to the developing portion opposed to the photosensitive drum 20. A high voltage generating circuit 24 is provided for applying a bias voltage to the developing sleeve 5.

The above-described developing device 1 may be incorporated in the image forming apparatus A or formed as a developing cartridge detachably mounted on the main body 16. In case of the configuration incorporated in the image forming, toner is replenished from a toner cartridge when the toner decreases in the toner container 3.

The term "developing cartridge" refers to a cartridge comprising of the developing sleeve 5, developer limiting member 4 and agitating rod 7 integrated by a cartridge frame 3*a*, and detachably mounted on the main body 16 of the apparatus. The cartridge frame 3*a* constituting the developing cartridge is housed in the interior of the main body 16, accessible by rotating a cover 17 upward about a hinge 17*a*. The left and right lateral walls of the main body 16 are provided with guide rails (not shown), and guide members provided on the developing cartridge on both ends in the longitudinal direction, which is the axial direction of the developing sleeve, are guided by the guide rails for mounting or detaching the developing cartridge.

Figure 2:
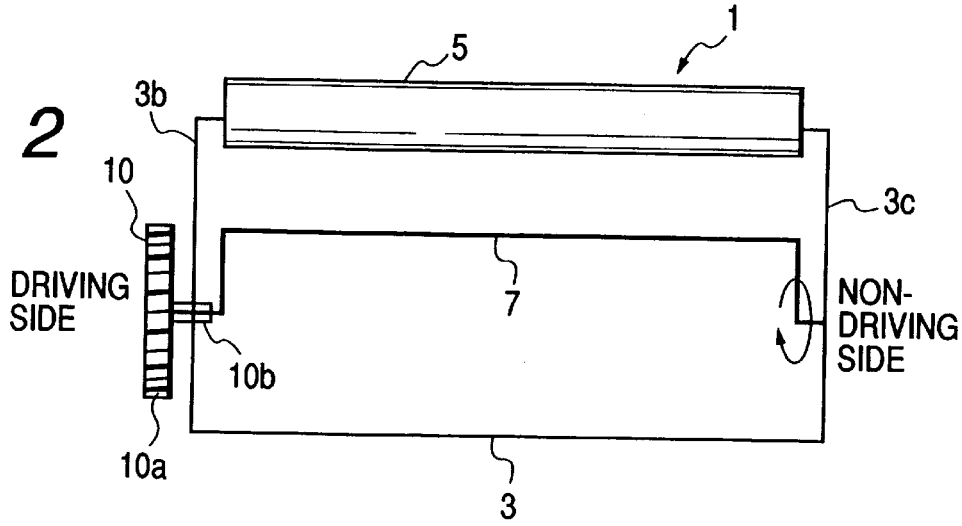
FIG. 2 is a schematic horizontal cross-sectional view of a developing device.

FIG. 2 is a plan view of the developing device 1 seen from above. The crank-shaped agitating rod 7 in the toner container 3 is provided, outside the toner container 3, with a tooth portion 10*a* meshing with an agitating drive gear 10 of which shaft 10*b* is rotatably supported on a drive-side lateral wall 3*b* of the container 3 and is thus rotated. The tooth portion 10*a* and the shaft portion 10*b* may be formed separately and fitted together, or may be integrally formed. Otherwise the tooth portion 10*a* and the shaft portion 10*b* may be formed separately and mutually connected by a shaft joint transmitting rotation. In the agitating rod 7, the side connected to the drive gear 10 will be called the driving side, and the opposite side will be called the non-driving side.

Figure 3:
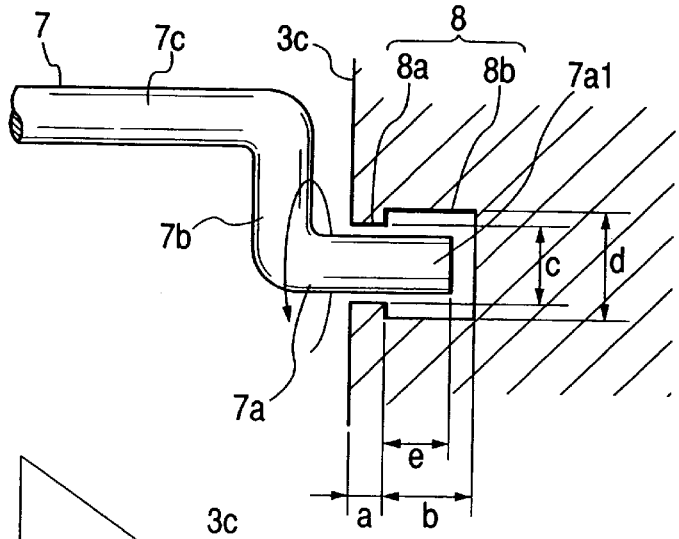
FIG. 3 is a schematic cross-sectional view of a bearing at the non-driving side in a first embodiment.

FIG. 3 is a magnified view of a bearing of the non-driving side, featuring the present invention, of the agitating rod 7. A cylindrical bearing hole 8 is provided on the lateral wall 3*c* of the non-driving side of the toner container 3. The bearing hole 8 is composed of a portion 8*a* for supporting the agitating rod 7, and an escape portion 8*b*, so formed that the inner wall of the bearing hole and the front end portion 7*a*1 of the agitating rod are not in frictional contact.

Investigation made by the present inventors has clarified that the aforementioned coarse toner particles are generated at the non-driving side of the agitating rod 7, more specifically by the frictional contact between the inner wall of the bearing hole at the support portion 8*a* and the journal 7*a* of the agitating rod 7.

In the present embodiment, the dimensions of the portions of the bearing hole 8 are so selected that the support portion 8*a* has a length a=1.5 mm and a diameter c=2.8 mm, the escape portion 8*b* has a length b=3.5 mm and a diameter d=3.2 mm, and the journal 7*a*, arm 7*b* and pin 7*c* of the agitating rod 7 have a common external diameter of 2 mm. The length a of the support portion 8*a* should be made as small as possible within the range tolerable in strength, in order to reduce the generation of the aforementioned coarse particles. The length b of the escape portion 8*b* is made larger than the longitudinal play e of the journal 7*a* of the agitating rod 7 (in the present embodiment, the end face of the journal 7*a* being unable to reach the support portion 8*a*), in order to prevent the agitating rod 7 from coming out of the support portion 8*a*. The inner diameter c of the support portion 8*a* has to be made larger than the outer diameter of the journal 7*a* of the agitating rod 7. The generation of the coarse particles is reduced by increasing the gap between the inner diameter c of the support portion and the journal 7*a* of the agitating rod 7, but the gap is selected as 0.8 mm in the present embodiment since an excessively large gap causes play in the rotation of the agitating rod 7. The inner diameter d of the escape portion 8*b* can be so arbitrarily selected as to form an escape space not coming in contact with the agitating rod 7.

The above-described configuration, in which the support portion 8*a* is made smaller to support the agitating rod 7 with a smaller area in comparison with the conventional configuration, drastically reduces the probability of the generation of coarse toner particles, whereby the generation of such coarse particles can be avoided. Also the support portion 8*a* is provided at the inside of the end of the agitating rod 7, so that the agitating rod 7 does not come off even though the agitating rod 7 has a certain play in the longitudinal direction as long as the length of the escape portion 8*b* is selected to be larger than the dimension of such play.

Second Embodiment

Figure 4:
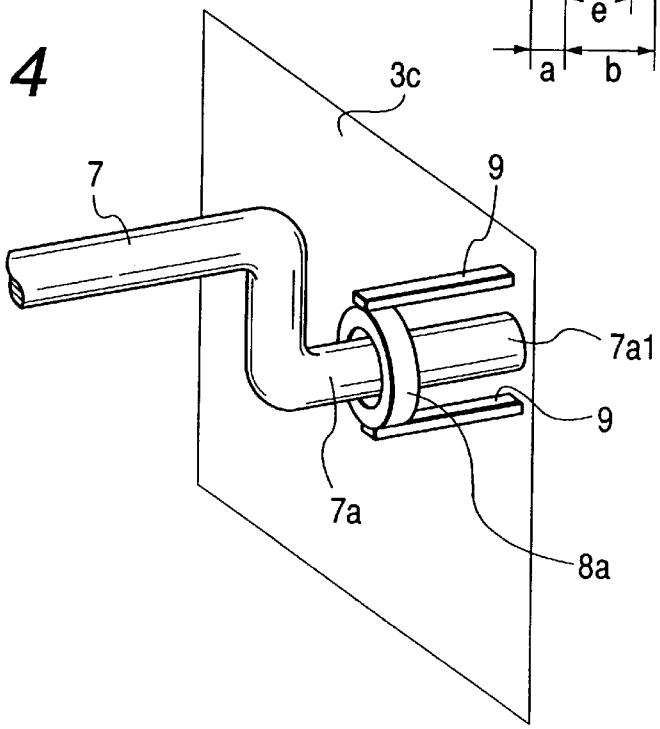
FIG. 4 is a perspective view of the bearing at the non-driving side in a second embodiment.

In the foregoing embodiment, the escape portion 8*b* positioned outside the support portion 8*a* is assumed to be a blind hole, but the present invention is naturally not limited to such configuration, and there may also be adopted a configuration as shown in FIG. 4, in which the support portion 8*a* is formed as a ring and is supported inside the toner container 3 by pillars 9 provided on the lateral wall 3*c* thereof, whereby the outer side of the support portion 8*a* communicates with the interior of the toner container 3. This variation includes any configuration in which the space around the end portion 7*a*1 of the journal 7*a* of the agitating rod 7, protruding outward from the support portion 8*a*, communicates with the interior of the toner container 3.

Third Embodiment

The present embodiment is featured, in the developing device of the first embodiment, by the fact that the developer container is composed of plural parts and that the bearing at the non-driving side is composed of two parts.

Figure 5:
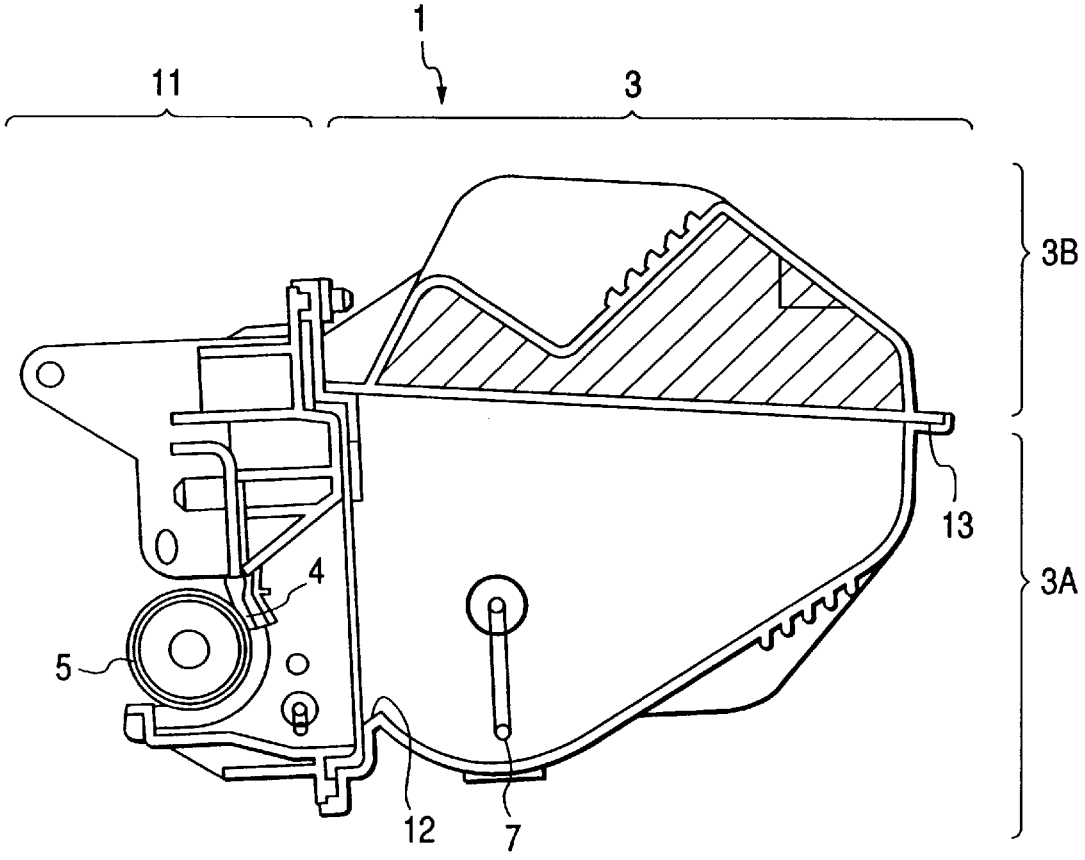
FIG. 5 is a longitudinal cross-sectional view of a developing device in a third embodiment.

Referring to FIG. 5, the developing device 1 is composed of a developer container 11 for developing the latent image with the developing sleeve 5 and a toner container 3 containing toner 6 employed as the developer, and the toner container 3 is composed of a hopper 3A and a cover member 3B.

Figure 6:
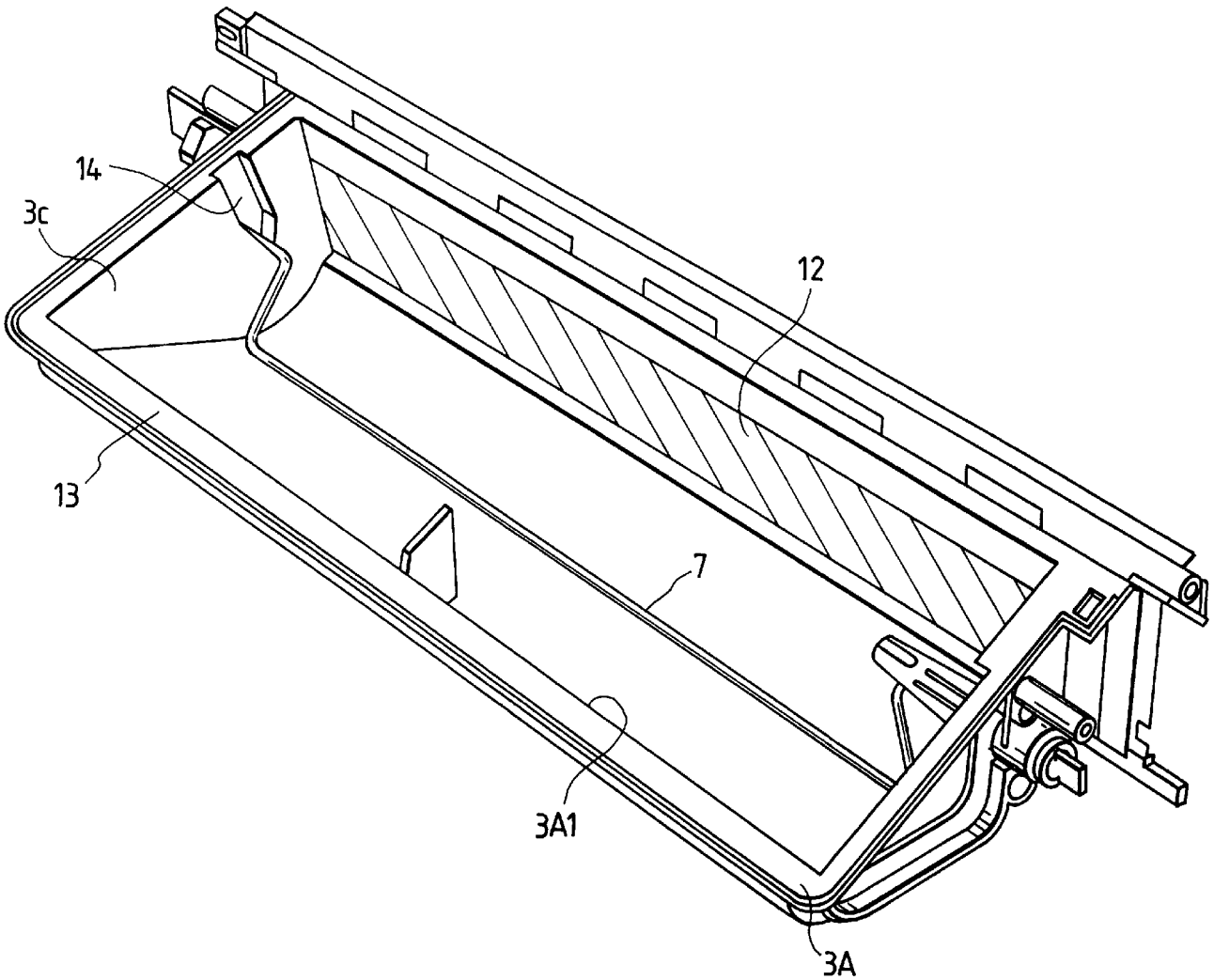
FIG. 6 is a perspective view of a hopper in the third embodiment.
Figure 7:
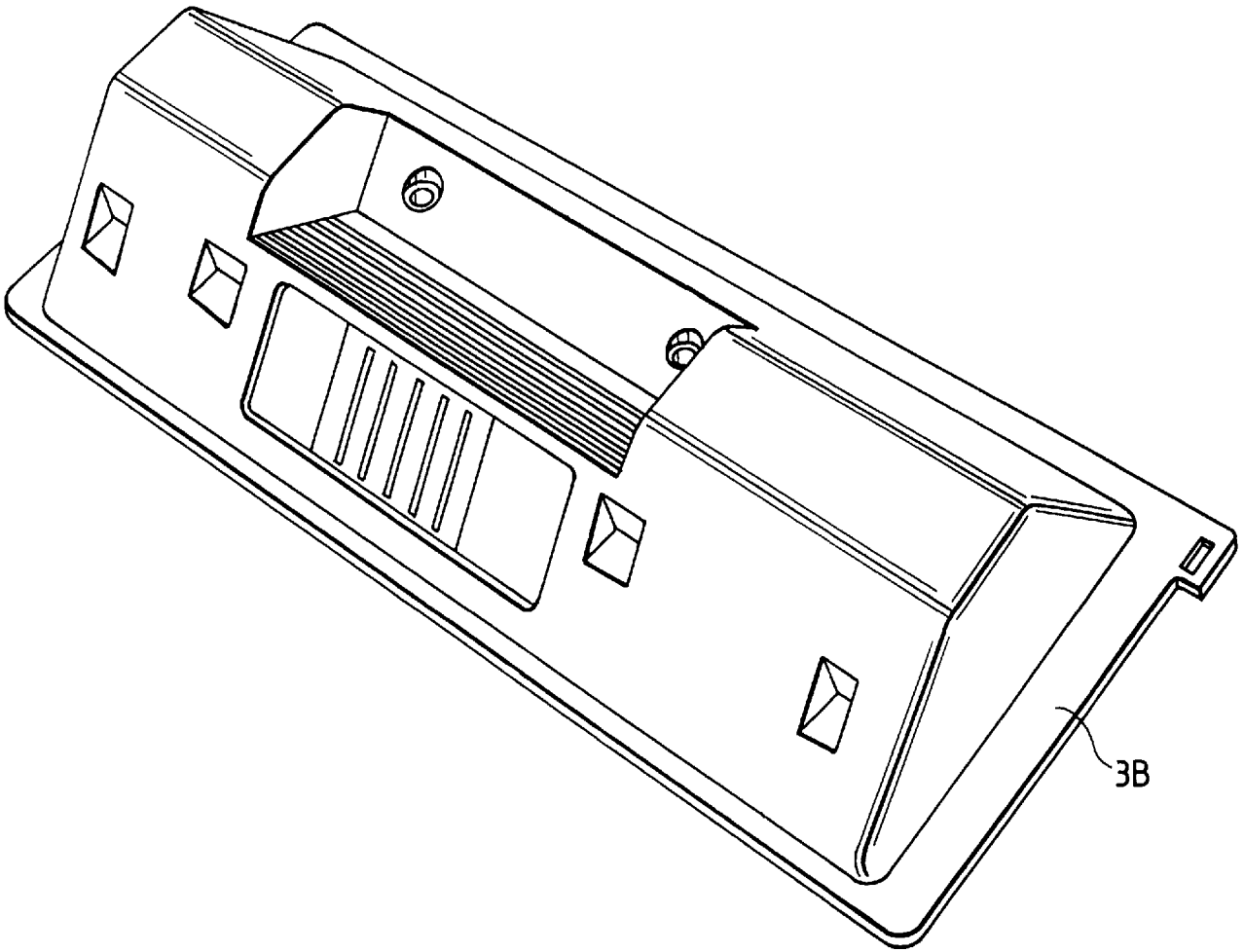
FIG. 7 is a perspective view, seen from above, of a cover member in the third embodiment.
Figure 8:
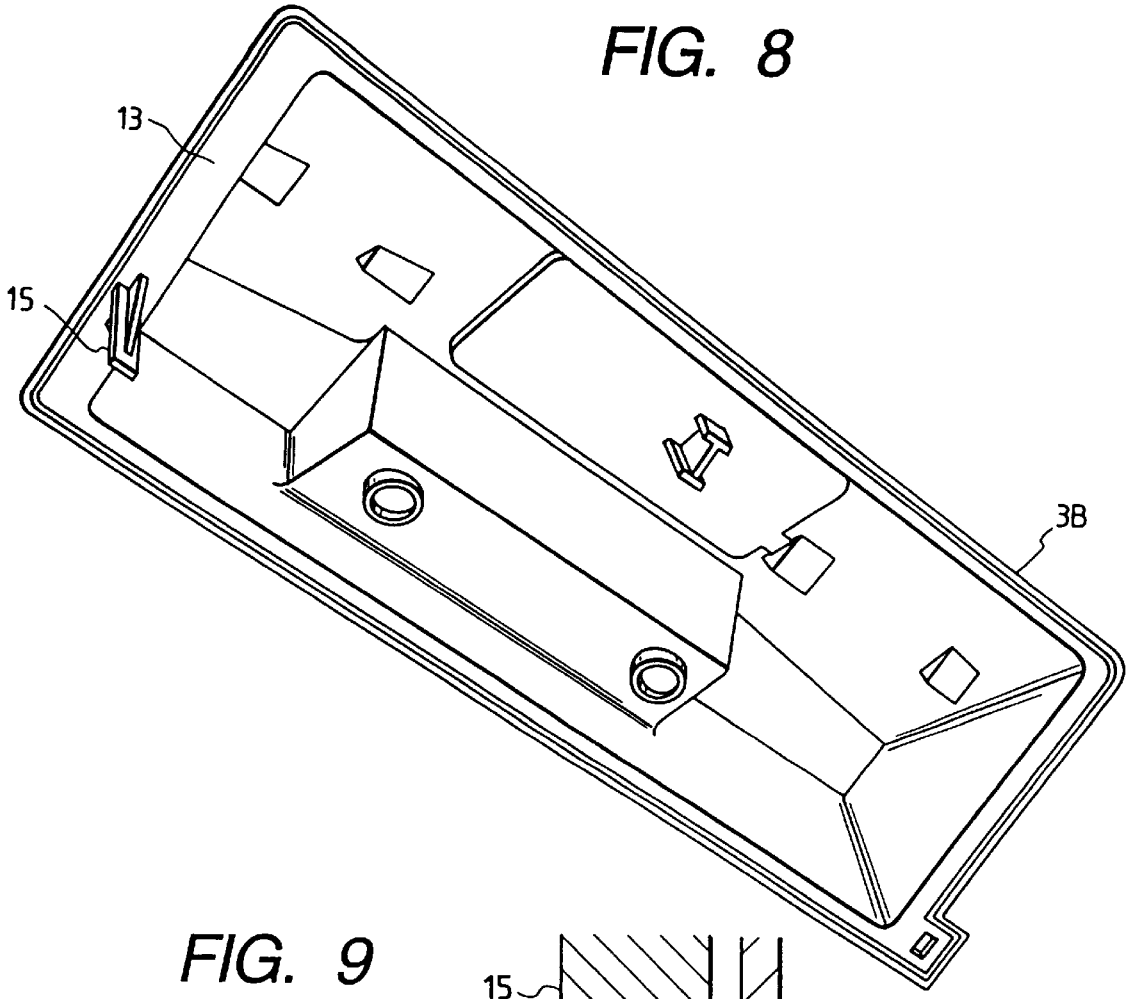
FIG. 8 is a perspective view, seen from below of the cover member in the third embodiment.

In the hopper 3A shown in FIGS. 6 to 8, there are provided an agitating rod 7 for agitating and transporting the developer in the hopper, and a toner supply aperture 12 for supplying the developer from the developer container to the developing means, and the edge of the aperture 12 is adhered to the corresponding aperture 12 of the developer container 11. A cover mounting surface (coupling surface) 13 is provided around a second aperture 3A1 opened upwards and provided separately from the aforementioned toner supply aperture 12. On the lateral wall 3*c* of the hopper 3A at the non-driving side, there is provided a groove 14 for accepting the agitating rod 14 when the cover mounting surface 13 is opened in such a manner that the width of the groove 14 gradually decreases downwards from the cover mounting surface 13.

The cover member 3B is so adhered by the cover mounting surface 13 as to cover the second aperture 3A1, and is provided with a projection 15 fitting into the groove 14.

Figure 9:
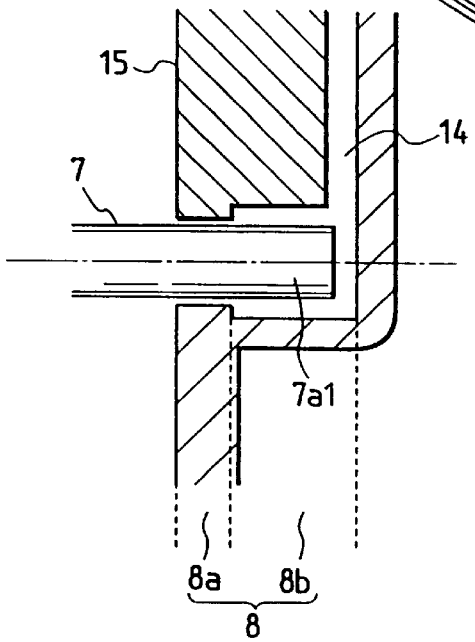
FIG. 9 is a schematic cross-sectional view of a bearing, at the non-driving side, in the third embodiment.

FIG. 9 is a lateral cross-sectional view of the bearing at the non-driving side. At the end of the groove 14, there are formed the lower part of the support portion 8*a* and the escape portion 8*b* in an arc shape having the center at the center of the journal 7*a* of the agitating rod 7, and, at the end of the projection 15, there are provided the upper portion of the support portion 8*a* and the escape portion 8*b* having the center at the center of the journal 7*a*.

When the agitating rod 7 is set into the hopper 3A prior to the assembling of the hopper 3A and the cover member 3B, the agitating rod 7 merely sits on the bottom end of the groove 14. However, as the cover member 3B is coupled with the hopper 3A, the projection 15 of the cover member 3B descends along the groove 14 of the hopper 3A so as to rotatably confine the agitating rod 7 from above, thereby forming the bearing hole 8. Thus, the agitating rod 7 is rotatably confined in the bearing hole 8, and a configuration similar to that of the foregoing embodiment can be realized by forming, in advance, a step difference between the support portion 8*a* and the escape portion 8*b* in the groove 14 and the projection 15.

As explained in the foregoing, the configuration of the bearing hole explained in the first embodiment can be very easily realized in the present embodiment by constituting the toner container with two members, namely the hopper and the cover member and forming the bearing hole for the agitating rod by the coupling of the groove of the hopper and the projection of the cover member. Consequently the effects explained in the first embodiment can be similarly realized.

Also the configuration that the toner container is constituted by two members, namely the hopper and the cover member, provides another advantage that developing devices of different capacities can be easily obtained without a major change in the shape, since the toner capacity can be varied by the shape of the cover member only.

Fourth Embodiment

The present fourth embodiment is featured by the fact that at least any one of the developing device and the photosensitive member described in the third embodiment, the charging device acting on the photosensitive member, the cleaning device and the used toner container for containing the developer collected by cleaning is formed as a process cartridge B detachably mounted on the main body 16 of the image forming apparatus. The foregoing description and drawings on the third embodiment are also applicable to the fourth embodiment.

Figure 11:
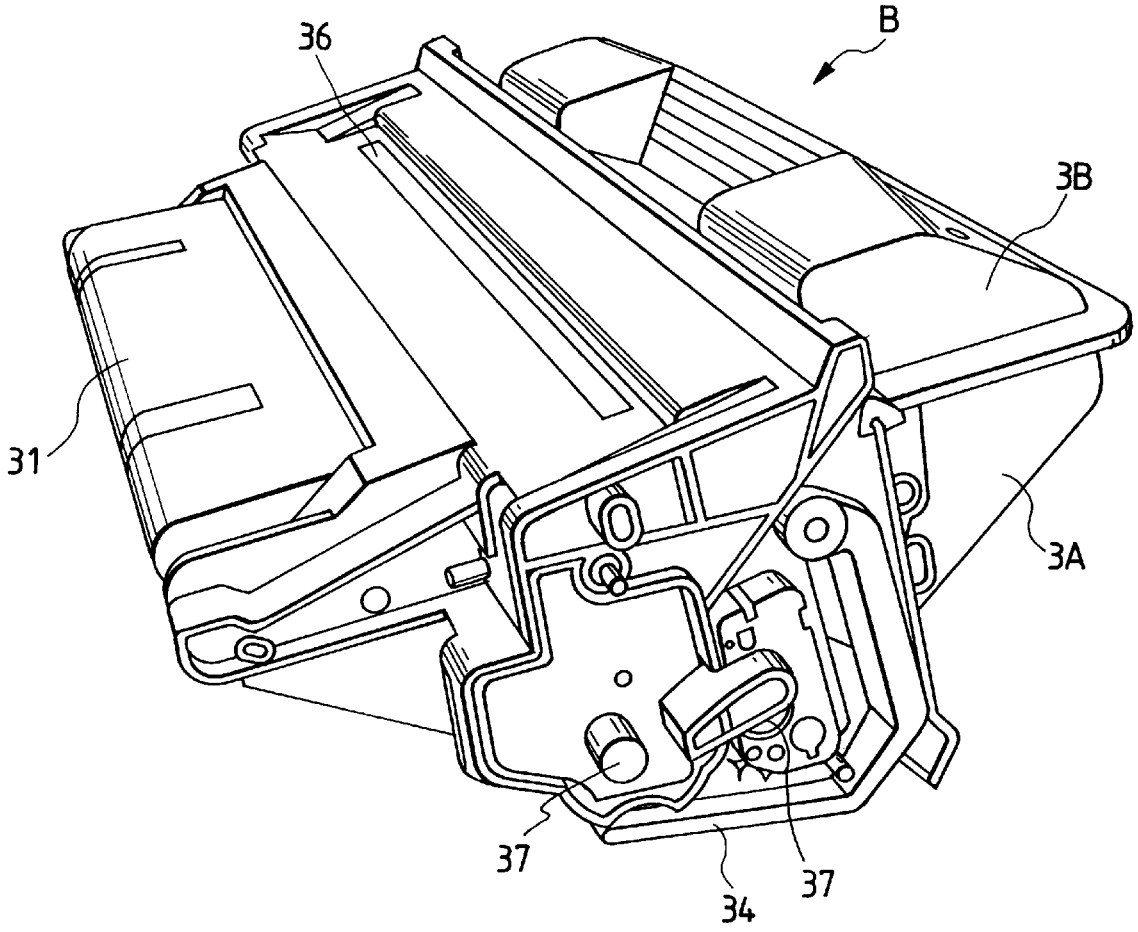
FIG. 11 is a perspective view of a process cartridge in the fourth embodiment.
Figure 12:
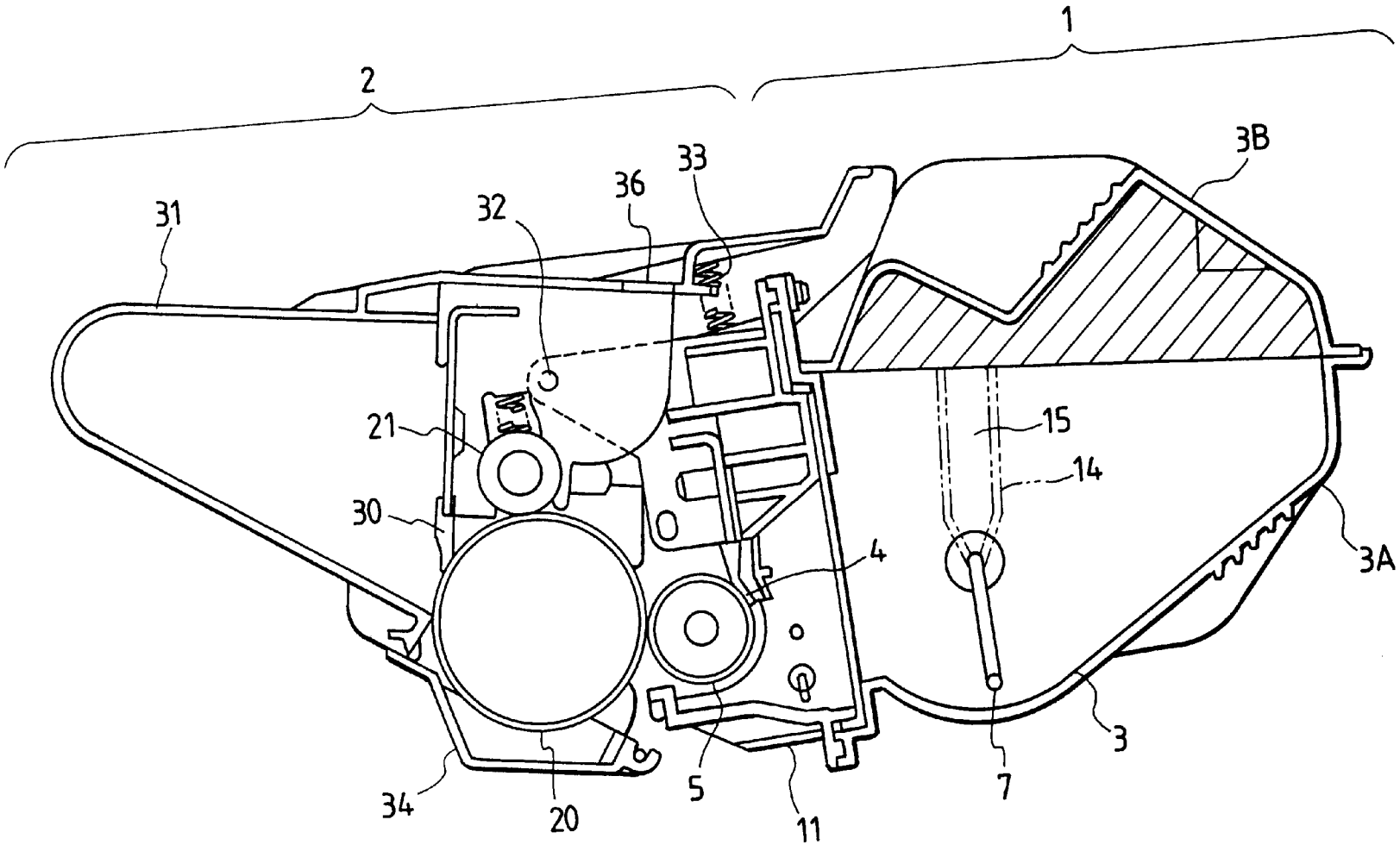
FIG. 12 is a longitudinal cross-sectional view of the process cartridge in the fourth embodiment.

As shown in FIGS. 11 and 12, the process cartridge 12 is divided into a unitized developing device 1 and a charging/cleaning portion (drum portion) 2.

The developing device 1 is composed of a developing limiting member 4, a developing sleeve 5 constituting a developer bearing member, a toner container 3 for containing the toner 6, an agitating rod 7 for agitating and transporting the toner 7, and a developing container 11 on which the developer limiting member 4 and the developing sleeve 5 are mounted.

The charging/cleaning portion 2 is composed of a photosensitive drum 20 constituting a latent image bearing member, a charging roller 21 constituting a charging device for uniformly charging the photosensitive drum 20, a cleaning blade 30 for eliminating the untransferred toner 6 from the photosensitive drum 20, and a used toner container 31.

The developing portion 1 and the charging/cleaning portion 2 are rotatably coupled by a coupling pin 32, and are mutually pressed by a pressure spring 33 provided between the developing container 11 and the used toner container 31, so that the photosensitive drum 20 is pressed to spacing rollers (not shown) fitted on both ends of the developing sleeve 5 and the photosensitive drum 20 and the developing sleeve 5 are always maintained at a closest gap (about 300 $\mu$m). A drum shutter 34 normally covers and protects the surface of the photosensitive drum 20, but is retracted to such a position as to allow the transfer roller 27 to contact the photosensitive drum 20 when the process cartridge B is mounted on the image forming apparatus A.

Figure 10:
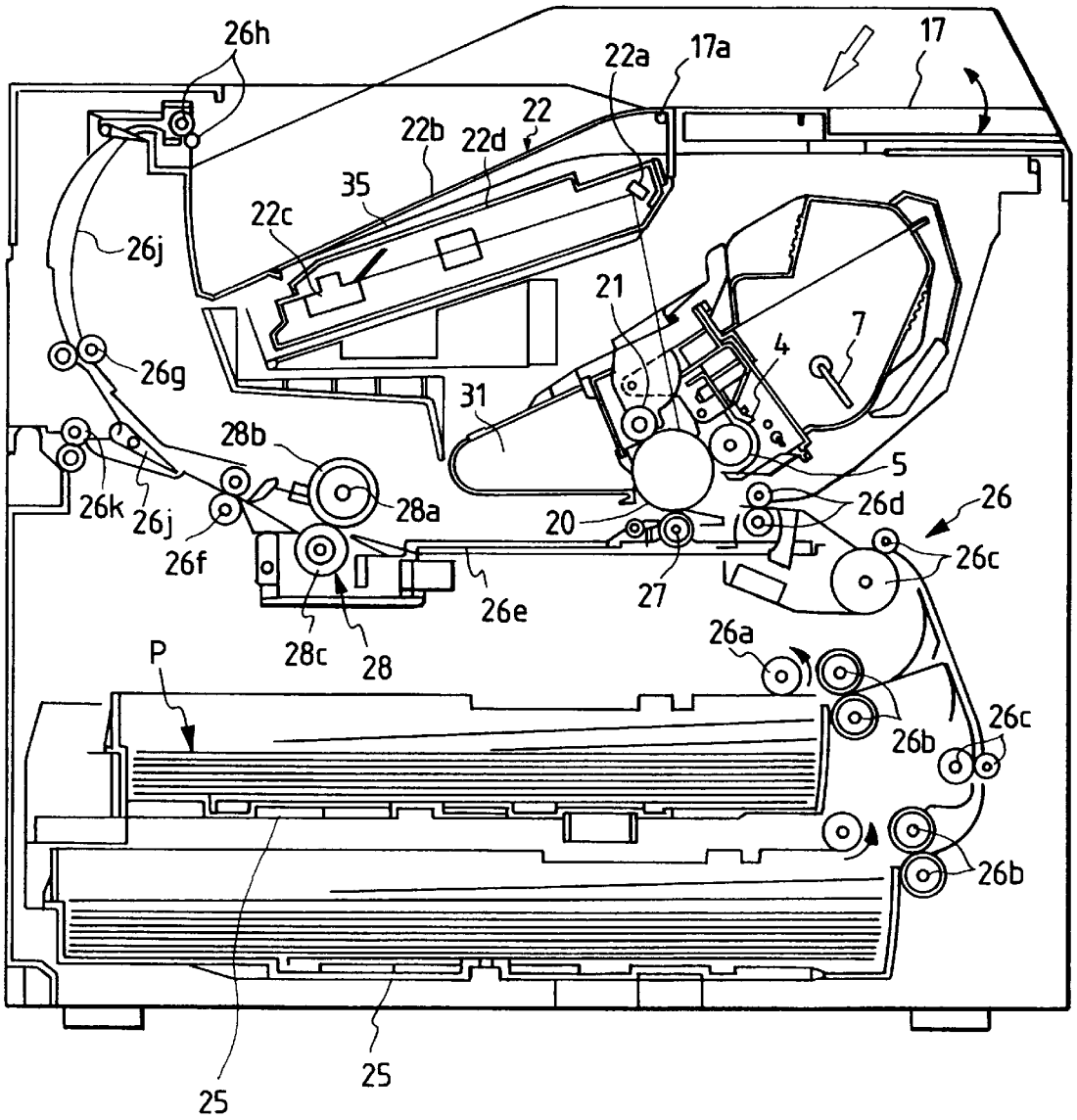
FIG. 10 is a longitudinal cross-sectional view of an electrophotographic image forming apparatus in a fourth embodiment.

When the cover 17 of the main body 16 of the image forming apparatus, as shown in FIG. 10, is rotated upward about the hinge 17*a*, there are exposed guide rails (not shown) on both sides of the main body 16. The process cartridge B can be mounted as shown in FIG. 10 by insertion into the main body 16, by fitting guide members 37 (FIG. 11) provided on the ends, in the longitudinal direction of the photosensitive drum 20, of the cartridge frame of the process cartridge B into the above-mentioned guide rails. The image formation is enabled when the cover 17 is closed by rotation downward about the hinge 17*a*.

The term "process cartridge" refers to a cartridge detachably mounted on the main body of the image forming apparatus and integrally containing the charging means or cleaning means, the developing means and the electrophotographic photosensitive member, or such a cartridge integrally containing at least either of the charging means and cleaning means, and the electrophotographic photosensitive member, or such a cartridge integrally containing at least the developing means and the electrophotographic photosensitive member.

In the following, there will be explained the function of the image forming apparatus A. The laser beam printer A is to form an image on a recording medium (for example recording paper, OHP sheet, cloth etc.) by an electrophotographic image forming process. A toner image is formed on a drum-shaped electrophotographic photosensitive member (hereinafter called "photosensitive drum"). More specifically, the photosensitive drum is charged by charging means, and irradiated with laser light corresponding to image information from optical means to form a latent image corresponding to the image information on the photosensitive drum.

Then the latent image is developed with developing means to form a toner image. In synchronization with the formation of the toner image, the recording medium P set in a sheet cassette 25 is reversed and transported by a pick-up roller 26*a* and paired registration rollers 26*b*. Then the toner image formed on the photosensitive drum 20 in the process cartridge B is transferred onto the recording medium P, by the application of a voltage to a transfer roller 27 constituting transfer means.

Subsequently, the recording medium P bearing the transferred toner image is transported, by a transport guide 26*e*, to fixing means 28, provided with a roller 28*c* and a fixing roller 28*b* incorporating a heater 28*a*. The transferred toner image is fixed by application of heat and pressure to the passing recording medium P.

The recording medium P is then transported by paired discharge rollers 26*f*, 26*g* and 26*h* and is discharged through an inversion path 26*i* onto a discharge tray 32 provided on the upper face of the main body 16 of the image forming apparatus A. The recording medium P may also be discharged without passing the inversion path 26*i*, by the movement of a flapper 26*j*.

In the present embodiment, transport means 26 is constituted by the pick-up roller 26*a*, paired transport rollers 26*b*, 26*c*, paired registration rollers 26*d*, transport guide 26*e*, paired discharge rollers 26*f*, 26*g* and 26*h* and paired discharge rollers 26*k*.

In the process cartridge B, the photosensitive drum 20 having a photosensitive layer is rotated as shown in FIG. 12, and the surface thereof is uniformly charged by voltage application to the charging roller 21 constituting the charging means. Then a laser beam emitted from the optical device 22 and modulated according to image information irradiates the photosensitive drum 20, thereby forming a latent image thereon, which is then developed with toner in the developing device 1. The charging roller 21 is maintained in contact with the photosensitive drum 20 and charges the photosensitive drum 20. The developing device 1 supplies a developing area of the photosensitive drum 20 thereby developing, thereby developing the latent image formed thereon.

Here, above-mentioned process cartridge detachably mountable on the electrophotographic image forming apparatus has the following construction. That is, the process cartridge comprises the electrophotographic photosensitive member (20), a developing member (for example, developing sleeve 5) for developing a latent image formed on said electrophotographic photosensitive member (20), a developer containing portion (for example, toner container 3) for containing a developer to be used in developing with said developing member, the latent image being formed on said electrophotographic photosensitive member, an agitating member (for example, agitating rod 7) for agitating the developer contained in said developer containing portion, and a frame (for example, cartridge frame 3*a*) rotatably supporting said agitating member and having a hole for rotatably supporting said agitating member, of which an end enters the hole and is rotatably supported by the hole. Wherein the length (for example, support portion 8*a*) of the agitating member in contact with the inner surface of the hole is shorter, in the longitudinal direction of the hole, than the length of the agitating member present in the hole (for example, hole 8).

Here, an end of the agitating member is positioned opposite to the other end at which a drive force receiving portion is provided for receiving a driving force for rotating the agitating member, and it is supported by the inner surface of the hole at the entrance portion of the hole.

The inner diameter of the entrance portion of the hole is smaller than the inner diameter at the deeper side of the hole; the end of said agitating member is supported by an end portion of a pillar protruding from the frame toward the interior of the developing containing portion; and the pillar is provided in plural numbers, and a circular support portion for supporting the agitating member is provided at the ends of the pillars.

The above-described configuration provides the advantages explained in the first to third embodiments. Also, the replacement of the component parts and the disposal of the removed toner can be easily executed without smearing of the ambience with toner. Consequently the serviceability of the image forming apparatus is significantly improved. Furthermore, a high image quality can always be maintained since the important components in the electrophotographic process can be renewed by the replacement of the process cartridge.

According to the foregoing embodiments, in the developing device including an agitating rod rotated therein and adapted to stir and transport the developer, the agitating rod is rotatably supported, at the non-driving side, at a position inward with respect to the non-driving end of the agitating rod, whereby the supporting area for the agitating rod is reduced to a necessary minimum to reduce the generation of coarse toner particles and eventually prevent generation of image defects, such as longitudinal white streaks.

As explained in the foregoing, the present invention enables one to reduce the generation of coarse toner particles.

What is claimed is:

1. A developing device for use in an electrophotographic image forming apparatus, comprising:

a developing member for developing a latent image formed on an electrophotographic photosensitive member;

a developer containing portion for containing a developer which is used for developing the latent image formed on the electrophotographic photosensitive member with said developing member; and an agitating member for agitating the developer contained in said developer containing portion, wherein said developer containing portion is provided with an inserted portion into which one end of said agitating member is inserted, wherein said inserted portion is contactable with an entire peripheral portion of said one end of said agitating member at an entrance side thereof, through which said one end of said agitating member is inserted, whereby said inserted portion rotatably supports said agitating member, and wherein said inserted portion is out of contact with said one end of said agitating member at a deeper side of said inserted portion.

2. A developing device according to claim 1, wherein agitating member is positioned opposite to the other end at which a drive forcej receiving portion is provided for receiving a driving force for rotating said agitating the other end of said agitating member is connected to a driving force transmitting portion to receive a driving force by which said agitating member is rotated.

3. A developing device according to claim 1 or 2, wherein said inserted portion defines a hole, and said one end of said agitating member is supported by an inner surface of said hole at an entrance portion of said hole.

4. A developing device according to claim 3, wherein the an inner diameter of the entrance portion of said hole is smaller than an inner diameter at the deeper side of said hole.

5. A developing device according to claim 1, wherein said inserted portion has a pillar protruding toward an interior of said developer containing portion, and said one end of said agitating member is supported by a distal end of said pillar.

6. A developing device according to claim 5, wherein said pillar is provided on each of a plurality of positions on said developer containing portion, and an annular supporting portion for supporting said agitating member is provided on distal ends of said pillars.

7. A developing device according to claim 1, wherein said developing device is a developing cartridge detachably mountable on a main body of said electrophotographic image forming apparatus.

8. A process cartridge detachably mountable on a main body of an electrophotographic image forming apparatus, comprising:

an electrophotographic photosensitive member;

a developing member for developing a latent image formed on said electrophotographic photosensitive member;

a developer containing portion for containing a developer which is used for developing the latent image formed on said electrophotographic photosensitive member with said developing member; and an agitating member for agitating the developer contained in said developer containing portion, wherein said developer containing portion is provided with an inserted portion into which one end of said agitating member is inserted, wherein said inserted portion is contactable with an entire peripheral portion of said one end of said agitating member at an entrance side thereof, through which said one end of said agitating member is inserted, whereby said inserted portion rotatably supports said agitating member, and wherein said inserted portion is out of contact with said one end of said agitating member at a deeper side of said inserted portion.

9. A process cartridge according to claim 8, wherein the other end of said agitating member is connected to a driving force transmitting portion to receive a driving force by which said agitating member is rotated.

10. A process cartridge according to claim 8 or 9, wherein said inserted portion defines a hole, and said one end of said agitating member is supported by an inner surface of said hole at an entrance portion of said hole.

11. A process cartridge according to claim 10, wherein an inner diameter of the entrance portion of said hole is smaller than an inner diameter at the deeper side of said hole.

12. A process cartridge according to claim 8, wherein said inserted portion has a pillar protruding toward an interior of said developer containing portion, and said one end of said agitating member is supported by a distal end of said pillar.

13. A process cartridge according to claim 12, wherein said pillar is provided on each of a plurality of positions on said developer containing portion, and an annular supporting portion for supporting said agitating member is provided on distal ends of said pillars.

14. A process cartridge according to claim 8, further comprising at least one of a charging member for charging said electrophotographic photosensitive member and a cleaning member for removing a developer remaining on said electrophotographic photosensitive member.

15. An electrophotographic image forming apparatus for forming an image on a recording medium, comprising:

a) an electrophotographic photosensitive member;

b) a developing device including:

a developing member for developing a latent image formed on said electrophotographic photosensitive member;

a developer containing portion for containing a developer which is used for developing the latent image formed on said electrophotographic photosensitive member with said developing member; and an agitating member for agitating the developer contained in said developer containing portion, wherein said developer containing portion is provided with an inserted portion into which one end of said agitating member is inserted, wherein said inserted portion is contactable with an entire peripheral portion of said one end of said agitating member at an entrance side thereof, through which said one end of said agitating member is inserted, whereby said inserted portion rotatably supports said agitating member, and wherein said inserted portion is out of contact with said one end of said agitating member at a deeper side of said inserted portion; and c) a driving force transmitting portion for transmitting a rotary driving force to the other end of said agitating member.

16. An electrophotographic image forming apparatus on which a process cartridge is detachably mountable for forming an image on a recording medium, comprising:

a) a mount portion onto which the process cartridge is detachably mountable, wherein the process cartridge includes:

an electrophotographic photosensitive member;

a developing member for developing a latent image formed on said electrophotographic photosensitive member;

a developer containing portion for containing a developer which is used for developing the latent image being formed on said electrophotographic photosensitive member with said developing member; and an agitating member for agitating the developer contained in said developer containing portion, wherein said developer containing portion is provided with an inserted portion into which one end of said agitating member is inserted, wherein said inserted portion is contactable with an entire peripheral portion of said one end of said agitating member at an entrance side thereof, through which said one end of said agitating member is inserted, whereby said inserted portion rotatably supports said agitating member, and wherein said inserted portion is out of contact with said one end of said agitating member at a deeper side of said inserted portion; and b) a driving force transmitting portion for transmitting a rotary driving force to the other end of said agitating member.

17. A developing device for use in an electrophotographic image forming apparatus, comprising:

a developing member for developing a latent image formed on an electrophotographic photosensitive member;

a developer containing portion for containing a developer which is used for developing the latent image formed on the electrophotographic photosensitive member with said developing member; and an agitating member for agitating the developer contained in said developer containing portion, wherein said developer containing portion is provided with a hole into which one end of said agitating member is inserted so that the agitating member is rotatably supported by said hole, and wherein a length of a portion, which is in contact with an inner surface of said hole, of said one end of said agitating member is shorter than a length of a portion, which is inserted into said hole, of said one end of said agitating member in a direction of a depth of said hole, and wherein in order to support said one end of said agitating member with said inner surface of said hole, an inner diameter of an entrance portion of said hole is smaller than an inner diameter at a deeper side of said hole.

18. A developing device according to claim 17, wherein the other end of said agitating member is connected to a driving force transmitting portion to receive a driving force by which said agitating member is rotated.

19. A developing device according to claim 17 or 18, wherein said one end of said agitating member is supported by the inner surface of said hole at the entrance portion of said hole.

20. A developing device according to claim 17, wherein said inserted portion has a pillar protruding toward an interior of said developer containing portion, and said one end of said agitating member is supported by a distal end of said pillar.

21. A developing device according to claim 20, wherein said pillar is provided on each of a plurality of positions on said developer containing portion, and an annular supporting portion for supporting said agitating member is provided on distal ends of said pillars.

22. A process cartridge detachably mountable on a main body of an electrophotographic image forming apparatus comprising:

an electrophotographic photosensitive member;

a developing member for developing a latent image formed on said electrophotographic photosensitive member;

a developer containing portion for containing a developer which is used for developing the latent image formed on the electrophotographic photosensitive member with said developing member; and an agitating member for agitating the developer contained in said developer containing portion, wherein said developer containing portion is provided with a hole into which one end of said agitating member is inserted so that the agitating member is rotatably supported by said hole, and wherein a length of a portion, which is in contact with an inner surface of said hole, of said one end of said agitating member is shorter than a length of a portion, which is inserted into said hole, of said one end of said agitating member in a direction of a depth of said hole, and wherein in order to support said one end of said agitating member with said inner surface of said hole, and inner diameter of an entrance portion of said hole is smaller than an inner diameter at a deeper side of said hole.

23. A process cartridge according to claim 22, wherein the other end of said agitating member is connected to a driving force transmitting portion to receive a driving force by which said agitating member is rotated.

24. A process cartridge according to claim 22 or 23, wherein said one end of said agitating member is supported by the inner surface of said hole at the entrance portion of said hole.

25. A process cartridge according to claim 22, wherein said inserted portion has a pillar protruding toward an interior of said developer containing portion, and said one end of said agitating member is supported by a distal end of said pillar.

26. A process cartridge according to claim 25, wherein said pillar is provided on each of a plurality of positions on said developer containing portion, and an annular supporting portion for supporting said agitating member is provided on distal ends of said pillars.

27. A process cartridge according to claim 22, further comprising at least one of a charging member for charging said electrophotographic photosensitive member and a cleaning member for removing a developer remaining on said electrophotographic photosensitive member.

28. A developing device for use in an electrophotographic image forming apparatus, comprising:

a developing member for developing a latent image formed on an electrophotographic photosensitive member;

a developer containing portion for containing a developer which is used for developing the latent image formed on the electrophotographic photosensitive member with said developing member; and an agitating member for agitating the developer contained in said developer containing portion, wherein said developer containing portion is provided with a hole into which one end of said agitating member is inserted, wherein said hole is contactable with said one end of said agitating member at an entrance side thereof, through which said one end of said agitating member is inserted, whereby said hole rotatably supports said agitating member, wherein said hole is out of contact with said one end of said agitating member at a deeper side of said hole, and wherein an inner diameter of the entrance side of said hole is smaller than an inner diameter of the deeper side of said hole.

29. A developing device for use in an electrophotographic image forming apparatus, comprising:

a developing member for developing a latent image formed on an electrophotographic photosensitive member;

a developer containing portion for containing a developer which is used for developing the latent image formed on the electrophotographic photosensitive member with said developing member; and an agitating member for agitating the developer contained in said developer containing portion, wherein said developer containing portion is provided with a plurality of pillars protruding toward an interior of said developer containing portion and an annular supporting portion provided on distal ends of said plurality of pillars, wherein one end of said agitating member is inserted into said annular supporting portion, whereby said annual supporting portion rotatably supports said agitating member.

30. A process cartridge detachably mountable on a main body of an electrophotographic image forming apparatus, comprising:

an electrophotographic photosensitive member;

a developing member for developing a latent image formed on said electrophotographic photosensitive member;

a developer containing portion for containing a developer which is used for developing the latent image formed on said electrophotographic photosensitive member with said developing member; and an agitating member for agitating the developer contained in said developer containing portion, wherein said developer containing portion is provided with a hole into which one end of said agitating member is inserted, wherein said hole is contactable with said one end of said agitating member at an entrance side thereof, through which said one end of said agitating member is inserted, whereby said hole rotatably supports said agitating member, wherein said hole is out of contact with said one end of said agitating member at a deeper side of said hole, and wherein an inner diameter of the entrance side of said hole is smaller than an inner diameter of the deeper side of said hole.

31. A process cartridge detachably mountable on a main body of an electrophotographic image forming apparatus, comprising:

an electrophotographic photosensitive member;

a developing member for developing a latent image formed on said electrophotographic photosensitive member;

a developer containing portion for containing a developer which is used for developing the latent image formed on said electrophotographic photosensitive member with said developing member; and an agitating member for agitating the developer contained in said developer containing portion, wherein said developer containing portion is provided with a plurality of pillars protruding toward an interior of said developer containing portion and an annular supporting portion provided on distal ends of said plurality of pillars, wherein one end of said agitating member is inserted into said annular supporting portion, whereby said annular supporting portion rotatably supports said agitating member.

* * * * *

UNITED STATES PATENT AND TRADEMARK OFFICE

CERTIFICATE OF CORRECTION

PATENT NO. : 6,131,007
DATED : October 10, 2000
INVENTOR(S) : Seiji Yamaguchi et al.

It is certified that error appears in the above-identified patent and that said Letters Patent is hereby corrected as shown below:

Title page,
Assignee, "Canon Kabushiki Kaisha, Toyko," should read -- Canon Kabushiki Kaisha, Tokyo, --.
Item [57] ABSTRACT, line 2, "apparatus," should read -- apparatus --.

Column 1,
Line 42, "image" should read -- the image --.

Column 8,
Line 7, "above-mentioned" should read -- the above-mentioned --.

Column 9,
Lines 25-26, should be deleted.
Line 27, "receiving a driving force for rotating said agitating" should be deleted.
Line 35, "the" should be deleted.

Column 11,
Line 38, "hole, and" should read -- hole, --.

Column 12,
Line 17, "hole, and" should read -- hole, --.

Signed and Sealed this

Sixteenth Day of April, 2002

*Attest:*

*Attesting Officer*

JAMES E. ROGAN
*Director of the United States Patent and Trademark Office*